US007086092B1

(12) United States Patent
Cruz

(10) Patent No.: US 7,086,092 B1
(45) Date of Patent: Aug. 8, 2006

(54) MAGNETICALLY ATTACHED SHIRT COLLAR

(75) Inventor: Charlie L. Cruz, Pueblo, CO (US)

(73) Assignee: Charles L. Cruz, Pueblo, CO (US)

( * ) Notice: Subject to any disclaimer, the term of this patent is extended or adjusted under 35 U.S.C. 154(b) by 0 days.

(21) Appl. No.: 11/282,383

(22) Filed: Nov. 21, 2005

(51) Int. Cl.
*A41B 3/00* (2006.01)

(52) U.S. Cl. ..... 2/132

(58) Field of Classification Search ..... 2/130, 2/131, 132–139, 255–260, 145, 260.1, 144, 2/261, 262, 231, 156, 232, 115, 116, 60, 129, 2/141.1, 155; 24/303, 66.1, 658, 688
See application file for complete search history.

(56) References Cited

U.S. PATENT DOCUMENTS

| | | | | | |
|---|---|---|---|---|---|
| 459,942 | A * | 9/1891 | Brown | 600/15 |
| 2,964,756 | A * | 12/1960 | Liebowitz | 2/132 |
| 3,102,314 | A * | 9/1963 | Alderfer | 24/303 |
| 3,131,932 | A * | 5/1964 | Maidment | 271/176 |
| 3,686,692 | A * | 8/1972 | Snare et al. | 2/132 |
| 3,909,850 | A * | 10/1975 | Scott | 2/132 |
| 4,118,803 | A * | 10/1978 | Blau | 2/132 |
| 4,286,337 | A * | 9/1981 | Malouf, Jr. | 2/116 |
| 4,434,512 | A * | 3/1984 | Hansen | 2/129 |
| 4,626,267 | A * | 12/1986 | Reese et al. | 65/106 |
| 4,653,119 | A * | 3/1987 | Kaiser | 2/60 |
| 5,740,557 | A * | 4/1998 | Reid et al. | 2/209.13 |
| 6,089,422 | A * | 7/2000 | Gibson | 223/84 |
| 6,163,889 | A * | 12/2000 | Tate | 2/209.13 |
| 6,167,732 | B1 * | 1/2001 | Friedman | 66/173 |
| 6,170,088 | B1 * | 1/2001 | Tate | 2/209.13 |
| 6,434,801 | B1 * | 8/2002 | Grunberger | 24/303 |
| 6,748,602 | B1 * | 6/2004 | Barnes | 2/132 |

* cited by examiner

*Primary Examiner*—Tejash Patel

(57) ABSTRACT

A shirt collar to removably attach around a neck portion of a shirt comprises: i) an elongate inner portion having an upper portion and a lower shirt portion, said lower shirt portion having magnets spaced and attached therealong; and, ii) an elongate outer portion having an upper portion continuously attached therealong to the upper portion of the inner portion, and having a lower portion having magnets positioned therealong to align with the magnets positioned along the shirt side portion of the inner side portion. In use after the collar is centrally folded therealong, between the inner and outer side portions thereof, the neck portion of the shirt can be positioned between the lower portions of the inner and outer collar; and thereafter the spaced magnets can adhere with the aligned magnets, thereby holding the collar along and attached to the neck porion of the shirt.

12 Claims, 1 Drawing Sheet

MAGNETICALLY ATTACHED SHIRT COLLAR

FIELD OF THE INVENTION

This invention relates to shirt collars. More particularly this invention relates to a magnetically attached shirt collar which can be readily attached to or removed from a collarless shirt.

BACKGROUND OF THE INVENTION

The inventor herein was confronted with dress codes on a golf course which prevented him from golfing in a collarless shirt. Similar dress codes often confront individuals who intend to dine, drink, or dance.

To comply with these dress codes a readily attached collar is disclosed herein. The collar is lightweight, and extremely compact when rolled up. The collar may be conveniently and unobtrusively carried in a golf bag or pocket. When needed the collar may be positioned over and above the neckline of a worn shirt. It is quickly magnetically attached to the neckline of a worn shirt. The attachment is unexpectedly rugged. During use the collar remains both continuously attached and in correct position. The design of the collar allows it to be inexpensively constructed in a universal formal white, or alternatively in the most delicate flamboyant patterns or bright eye catching colors.

The ease of application and the rugged effectiveness of the magnetically attachable collar does more than make the collar a popular choice to fulfil the need of individuals to comply with dress codes. The simple and inexpensive construction of the collar also allow the collar, made from varying fabrics, to adapt a conventional shirt or blouse to many different occasions. With a flamboyantly colored fabric office apparel can become evening apparel. Or alternatively, a lightly tinted blouse could color coordinated to an array of skirts or accessories. It is contemplated that the functional design herein could facilitate convenient and inexpensive high fashion.

OBJECTS OF THE INVENTION

It is an object of this invention to disclose a functional and rugged design and method of removably attaching a collar to a shirt or blouse. It is an object of this invention to allow individuals to momentarily comply with dress codes requiring a collared shirt when they are wearing a collarless shirt. It is yet a further object of this invention to disclose a simple and inexpensive design for a collar that will facilitate adapting a basic shirt or blouse to a whole array of different social situations. It is yet a final object of this invention to facilitate color coordinating a basic blouse to a multitude of varying dress accessories.

One aspect of this invention provides for a shirt collar to removably attach around a neck portion of a shirt comprises: i) an elongate inner portion having an upper portion and a lower shirt portion, said lower shirt portion having magnets spaced and attached therealong; and, ii) an elongate outer portion having an upper portion continuously attached therealong to the upper portion of the inner portion, and having a lower portion having magnets positioned therealong to align with the magnets positioned along the shirt side portion of the inner side portion. In use after the collar is centrally folded therealong, between the inner and outer side portions thereof, the neck portion of the shirt can be positioned between the lower portions of the inner and outer collar; and thereafter the spaced magnets can adhere with the aligned magnets, thereby holding the collar along and attached to the neck porion of the shirt.

In a preferred aspect of this invention the

Various other objects, advantages and features of this invention will become apparent to those skilled in the art from the following description in conjunction with the accompanying drawings.

FIGURES OF THE INVENTION

Figure 1:
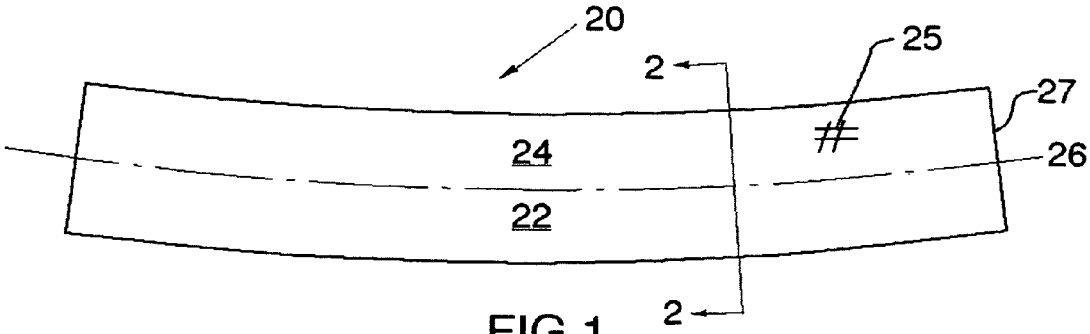
FIG. 1 is a plan view of an unattached shirt collar.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
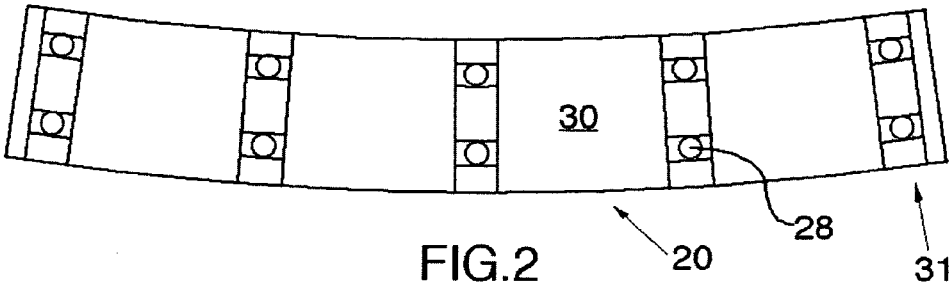
FIG. 2 is a cross sectional view of the collar shown in FIG. 1 taken along line 2—2 therein.

Turning now to the drawings and more particularly to FIG. 1 we have a plan view of an unattached shirt collar 20. FIG. 2 is a cross sectional view of the collar 20 shown in FIG. 1 taken along line 2—2 therein. Most generally, the shirt collar 20, which removably attaches around a neck portion of a shirt 18 comprises: i) an elongate inner portion 22 having an upper portion and a lower shirt portion, said lower shirt portion having magnets 28 spaced and attached therealong; and, ii) an elongate outer portion 24 having an upper portion continuously attached therealong (fold line 26) to the upper portion of the inner portion 22, and having a lower portion having magnets 28 positioned therealong to align with the magnets 28 positioned along the lower shirt side portion of the inner portion 22. In use after the collar 20 is centrally folded therealong fold line 26, between the inner and outer side portions thereof, the neck portion of the shirt 18 can be positioned between the lower portions of the inner 22 and outer 24 collar portions; and thereafter the spaced magnets 28 can adhere with the aligned magnets 28, thereby holding the collar 20 along and attached to the neck portion of the shirt 18.

Most preferably the inner 22 and outer collar portions 24 comprise opposite fabric sides 25, said fabric sides 25 peripherally stitched 27 together therearound. Most preferably an interfacing 30 is layered between the fabric sides 25 to stiffen the collar 20.

Figure 3:
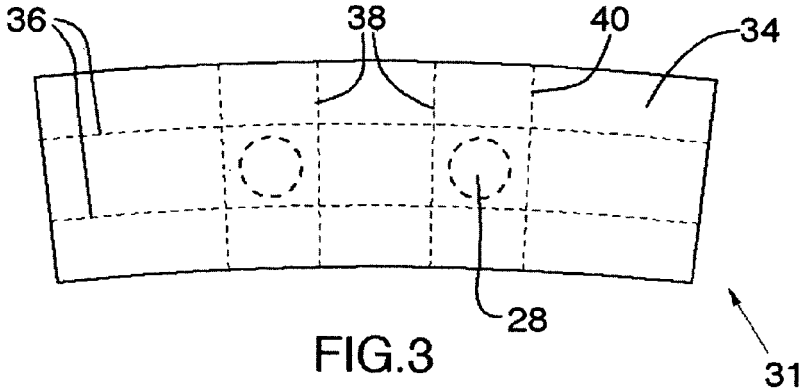
FIG. 3 is a plan view of a microfiber strip used in the collar to hold and position magnets therein. These strips are sewn into the interior of the collar as shown in FIG. 2.

FIG. 3 is a plan view of a microfiber strip 31 used in the collar 20 to hold and position magnets 28 therein. These strips 28 are sewn into the interior of the collar 20 as shown in FIG. 2. Most preferably magnet holding sleeves 32 are used to maintain the magnets 28 in correct position. Said magnets 28 are positioned by stitching 27 within the sleeve 32, and said sleeves 32 are later stitched 27 between the fabric sides 30 of the inner 22 and outer 24 collar portions. In the most preferred embodiment of the invention two separate rectangular pieces of material 34 are aligned and attached together by two spaced central columns 36 of parallel stitching therealong, and the two pieces of fabric additionally have two spaced rows 38 of parallel stitching thereacross, so that after two magnets 28 are inserted from opposite ends of the rectangular pieces 34, between the rectangular pieces of material 34 and between the columns 36 of stitching, to and as far as the rows 38 of stitching thereacross, then two additional rows 40 can be stitched outside of the magnets 28 thereby securely positioning the magnets 28 between the two pieces of material 34.

Figure 4:
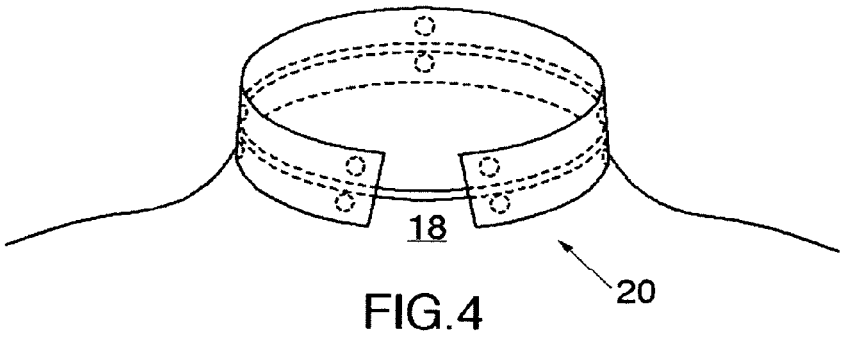
FIG. 4 is a perspective view of a removable collar positioned and attached on a shirt.

FIG. 4 is a perspective view of a removable collar 20 positioned and attached on a neck portion of a shirt 28. The magnets 28 on opposite end portions of the collar 20 are configured to generally project a magnetic field over the major neck arteries and the thymus gland in the neck so that the body will benefit from the magnetic fields.

A method of removably attaching a collar 20 to a neck portion of a shirt 18 comprising the steps of: i) providing a shirt collar 20 as in claim 1; ii) folding 26 the shirt collar 20 centrally therealong; iii) positioning the neck portion of the shirt 18 between the lower portions of the inner 22 and outer collar 24; and thereafter, iv) adhering the spaced magnets 28 to the aligned magnets 28, thereby holding the collar 20 along and attached to the neck porion of the shirt 18. This method can be further limited as was the most general apparatus claim for the removable shirt collar 20 above by the same specifics listed above.

While the invention has been described with preferred specific embodiments thereof, it will be understood that this description is intended to illustrate and not to limit the scope of the invention, which is defined by the following claims.

I claim:

1. A shirt collar to removably attach around a neck portion of a shirt comprising:

an elongate inner portion having an upper portion and a lower shirt portion, said lower shirt portion having magnets spaced and attached therealong; and, an elongate outer portion having an upper portion continuously attached therealong to the upper portion of the inner portion, and having a lower portion having magnets positioned therealong to align with the magnets positioned along the shirt side portion of the inner side portion;

so that in use after the collar is centrally folded therealong, between the inner and outer side portions thereof, the neck portion of the shirt can be positioned between the lower portions of the inner and outer collar; and thereafter the spaced magnets can adhere with the aligned magnets, thereby holding the collar along and attached to the neck porion of the shirt.

2. A shirt collar as in claim 1 further wherein the inner and outer collar portions comprise opposite fabric sides, said fabric sides peripherally stitched together therearound.

3. A shirt collar as in claim 2 further comprising an interfacing layered between the fabric sides to stiffen the collar.

4. A shirt collar as in claim 3 further comprising magnet holding sleeves, said magnets being positioned by stitching within the sleeve, and said sleeves stitched between the fabric sides of the inner and outer collar portions.

5. A shirt collar as in claim 4 wherein the two separate rectangular pieces of material are aligned and attached together by two spaced central columns of parallel stitching therealong, and the two pieces of fabric additionally have two spaced rows of parallel stitching thereacross, so that after two magnets are inserted from opposite ends of the rectangular pieces, between the pieces of material and between the columns of stitching, to and as far as the rows of stitching thereacross, then two additional rows can be stitched outside of the magnets thereby securely positioning the magnets between the two pieces of material.

6. A shirt collar as in claim 5 wherein the magnets on opposite end portions of the collar are configured to generally align over the major neck arteries and the thymus gland in the neck so that the body will benefit from the magnetic fields.

7. A method of removably attaching a collar to a neck portion of a shirt comprising the steps of:

providing a shirt collar as in claim 1;

folding the shirt collar centrally therealong;

positioning the neck portion of the shirt between the lower portions of the inner and outer collar; and thereafter, adhering the spaced magnets with the aligned magnets, thereby holding the collar along and attached to the neck porion of the shirt.

8. A shirt collar as in claim 7 further wherein the inner and outer collar portions comprise opposite fabric sides, said fabric sides peripherally stitched together therearound.

9. A shirt collar as in claim 8 further comprising a stiffening layer positioned between the fabric sides.

10. A shirt collar as in claim 9 further comprising magnet holding sleeves, said magnets being positioned by stitching within the sleeve, and said sleeves stitched between the fabric sides of the inner and outer collar portions.

11. A shirt collar as in claim 10 wherein the two separate rectangular pieces of material are aligned and attached together by two spaced central columns of parallel stitching therealong, and the two pieces of fabric additionally have two spaced rows of parallel stitching thereacross, so that after two magnets are inserted from opposite ends of the rectangular pieces, between the fabric sides and between the columns of stitching, to and as far as the rows of stitching thereacross, then two additional rows can be stitched outside of the magnets thereby securely positioning the magnets between the two sides of fabric.

12. A shirt collar as in claim 11 wherein the magnets on opposite end portions of the collar are configured to generally align over the major neck arteries and the thymus gland in the neck so that the body will benefit from the magnetic fields.

* * * * *